US006336759B1

(12) United States Patent
Nakano

(10) Patent No.: US 6,336,759 B1
(45) Date of Patent: Jan. 8, 2002

(54) SHEET FEEDING APPARATUS AND IMAGE FORMING APPARATUS

(75) Inventor: Yuji Nakano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/568,799

(22) Filed: May 11, 2000

(30) Foreign Application Priority Data

May 14, 1999 (JP) ..... 11-133759
May 14, 1999 (JP) ..... 11-134956
May 14, 1999 (JP) ..... 11-134957

(51) Int. Cl.[7] ..... B41J 11/26; B41J 13/20; B41J 2/315

(52) U.S. Cl. ..... 400/625; 400/629; 400/120.01

(58) Field of Search ..... 400/625, 629, 400/120.01

(56) References Cited

U.S. PATENT DOCUMENTS 4,275,969 A * 6/1981 Matasuhisa et al. ..... 400/625
4,577,984 A * 3/1986 Yamamoto et al. ..... 400/625
5,238,235 A * 8/1993 Nitta et al. ..... 400/629
6,082,912 A * 7/2000 Shimizu et al. ..... 400/120.01

* cited by examiner

*Primary Examiner*—John S. Hilten
*Assistant Examiner*—Marvin P. Crenshaw
(74) *Attorney, Agent, or Firm*—Fitzpatrick, Cella, Harper & Scinto

(57) ABSTRACT

A sheet feeding apparatus including a feeding roller for separating and feeding a sheet, a conveying roller for conveying the sheet, a drive motor directly connected to the conveying roller and capable of being rotated forwardly and reversely, a drive intermittent device for selectively transmitting a driving force from the drive motor to the feeding roller, and a drive switching device for rotating the feeding roller in a conveying direction regardless of a rotational direction of the drive motor, and wherein, in the drive switching device, a spring clutch is used as a one-way clutch for effecting drive transmitting when the drive motor rotates the conveying roller in the conveying direction as forwardly rotation and a clutch of pendulum type is used as a one-way clutch for effecting the drive transmission when the drive motor rotates the conveying roller in a direction opposite to the conveying direction as reverse rotation, and the number of gears is differentiated between the forward rotation and the reverse rotation by one or odd.

32 Claims, 10 Drawing Sheets

SHEET FEEDING APPARATUS AND IMAGE FORMING APPARATUS

BACKGROUND OF THE INVENTION

1. Field of the Invention

The present invention relates to a sheet feeding apparatus, and more particularly it relates to a sheet feeding apparatus in which a feeding roller and a conveying roller are driven by a single motor. The sheet feeding apparatus according to the present invention can particularly been used in an image forming apparatus.

2. Related Background Art

In image forming apparatuses of serial type, a carriage on which a recording head is mounted is scanned in a main scanning direction to record an image, and a sheet is conveyed intermittently in a direction (sub-scanning direction) perpendicular to the main scanning direction to record an image on the entire sheet.

With the arrangement as mentioned above, resolution in the main scanning direction is directly determined by resolution of recording means; whereas, connecting portions between the images in the sub-scanning direction are determined by sheet conveying accuracy. That is to say, continuity of the image in the sub-scanning direction is apt to be conspicuous because it is determined by a factor different from that in the main scanning direction, and, it is preferable that conveying means (generally, a conveying roller) is directly connected to a drive motor and is controlled accurately.

On the other hand, in such an apparatus, sheets stacked in a feeding portion are separated and fed by feeding means, and the sheet is subjected to correction of skew-feed by the conveying means (generally, a roller which will be referred to as "conveying roller" hereinafter) and is conveyed to the recording means by the conveying roller. When a roller (referred to as "feeding roller" hereinafter), is used as the feeding means, the feeding roller must be driven only upon separation and feeding of the sheet and be stopped except this, and, it is preferable that the feeding roller is separated from the sheet when the feeding roller is stopped. Thus, in order to drive the conveying roller and the feeding roller by a single drive motor, drive intermittent means must be provided.

When the sheet is conveyed after the skew-feed of the sheet is corrected, in a state that the feeding roller is always rotated forwardly, the conveying roller must be rotated reversely and then be rotated forwardly. That is to say, even when the drive motor is rotated in either direction, the feeding roller must be designed so that the forward driving force is transmitted to the feeding roller. In a conventional arrangement, a drive transmitting mechanism for forward rotation of the motor and a drive transmitting mechanism for reverse rotation of the motor are switched by using drive switching means, and the numbers of gears used in these drive transmitting mechanisms are differentiated between the drive transmitting mechanisms by one or odd number, and a one-way clutch is incorporated into each of the drive transmitting mechanisms.

In the above-mentioned arrangement, the skew-feed of the sheet is corrected by abutting the sheet by the feeding roller against the reversely rotated conveying roller. Then, the drive motor is rotated forwardly to convey the sheet, thereby entering the sheet into a nip of the conveying roller (nipping). If the sheet is flexed due to an excessive feeding amount of the feeding roller during the correction of the skew-feed, the nipping can be facilitated by an elastic restoring force of the sheet. However, if the sheet has a great rigidity, the skew-feed of the sheet is corrected by the relative slipping movement between the feeding roller and the sheet. Therefore, a force for the nipping becomes only a friction force between the conveying roller and the sheet. Accordingly, in consideration of various kinds of sheets, environment and endurance, only this arrangement cannot ensure the secure nipping and the aid of the feeding roller is required. Thus, the feeding roller is designed so as to continue the forward rotation even after the conveying roller starts the forward rotation.

However, in the above-mentioned arrangement, in a case that a clutch of pendulum type which is relatively inexpensive is used as the one-way clutch, a pendulum movement is caused when the rotational direction of the conveying roller is changed from the reverse rotation to the forward rotation. Therefore, a time lag is created, with the result that the feeding roller will not yet be rotated just when the nipping is needed. Consequently, there arises dispersion in leading end margin and nipping timing differs between the left side and the right side, thereby generating the skew-feed. In order to avoid this, a spring clutch or a one-way clutch of needle type which have less time lag may be used, but these are expensive.

SUMMARY OF THE INVENTION

An object of the present invention is to provide a sheet feeding apparatus comprising a feeding roller for separating and feeding a sheet from a sheet stack, a conveying roller for conveying the sheet, a drive motor directly connected to the conveying roller and being rotatable forwardly and reversely, drive intermittent means for selectively transmitting a driving force from the drive motor to the feeding roller, and drive switching means for rotating the feeding roller in a conveying direction regardless of a rotational direction of the drive motor, wherein, in the drive switching means, a spring clutch is used as a one-way clutch for effecting drive transmission when the drive motor rotates the conveying roller in the conveying direction (referred to as "forward rotation" hereinafter) and a clutch of pendulum type is used as a one-way clutch for effecting the drive transmission when the drive motor rotates the conveying roller in a direction opposite to the conveying direction (referred to as "reverse rotation" hereinafter), and a number of gears used for the forward rotation is different from a number of gears used for the reverse rotation by one or odd number.

Another object of the present invention is to provide an image forming apparatus comprising a feeding roller for feeding out a sheet, sheet stacking means for stacking the sheets and movable toward the feeding roller to abut the sheets against the feeding roller in association with rotation of the feeding roller, a conveying roller for conveying the sheet fed by the feeding roller, an image forming portion for forming an image on the sheet conveyed by the conveying roller while moving in a direction perpendicular to a sheet conveying direction, a motor for driving the conveying roller directly, and drive transmitting means including a gear portion directly connected to the feeding roller, clutch means for selectively being engaged with and disengaged from the gear portion thereby to transmit a driving force of the motor to the gear portion, and engagement means for engaging the clutch means with the gear portion in association with the movement of the image forming portion, wherein when the gear portion and the clutch means are once engaged with each other, the drive transmitting means rotates the feeding roller through a predetermined number of revolutions even after the engagement between the gear portion and the clutch means is released, and wherein, after the clutch means are engaged with the gear portion of the feeding roller by the engagement means and before the sheet abuts against the feeding roller, the engagement is released.

DETAILED DESCRIPTION OF THE PREFERRED EMBODIMENTS

An image forming apparatus according to an embodiment of the present invention will now be explained with reference to the accompanying drawings.

Figure 1:
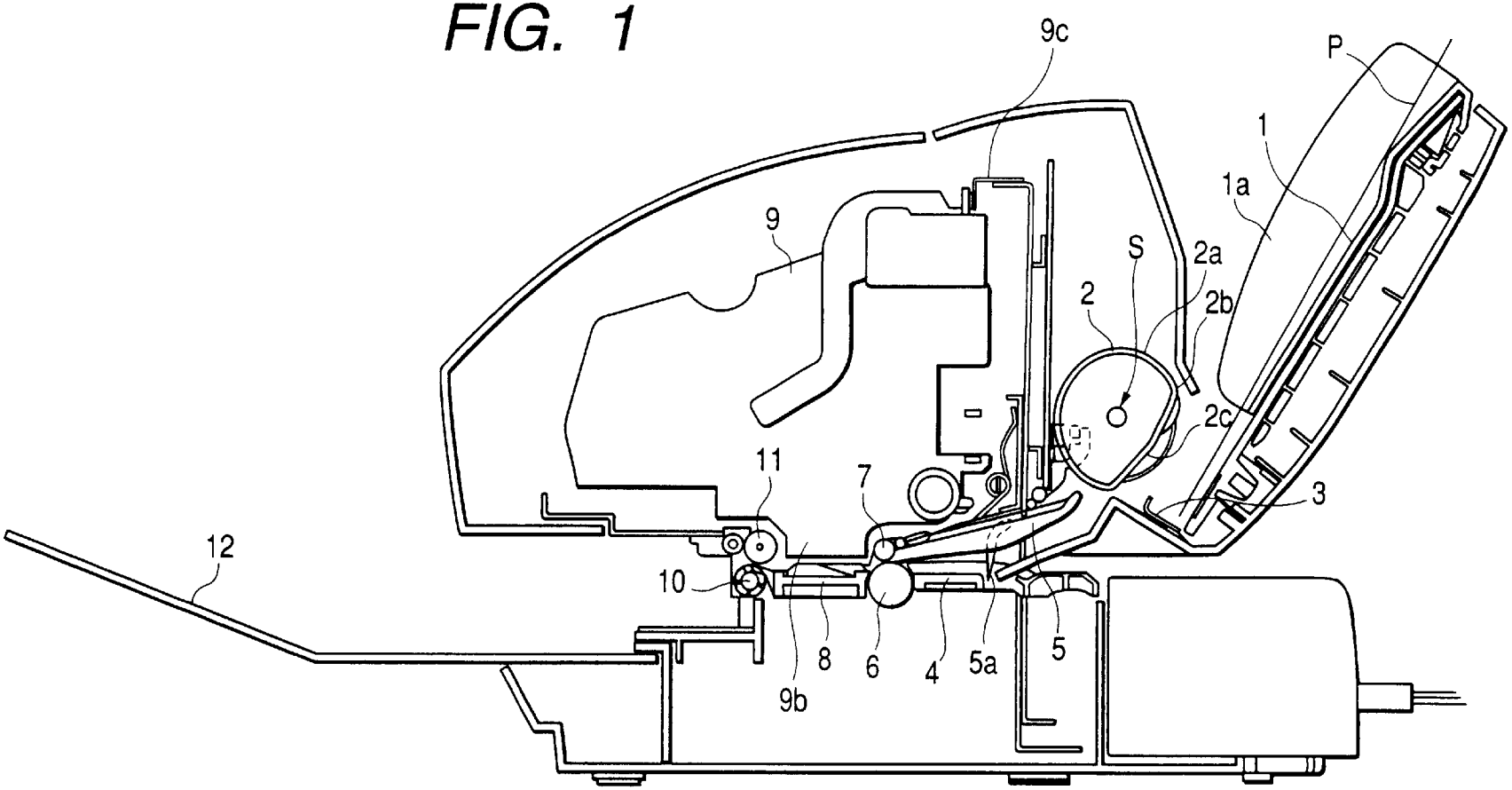
FIG. 1 is a view showing an entire construction of an image forming apparatus according to an embodiment of the present invention.
Figure 2:
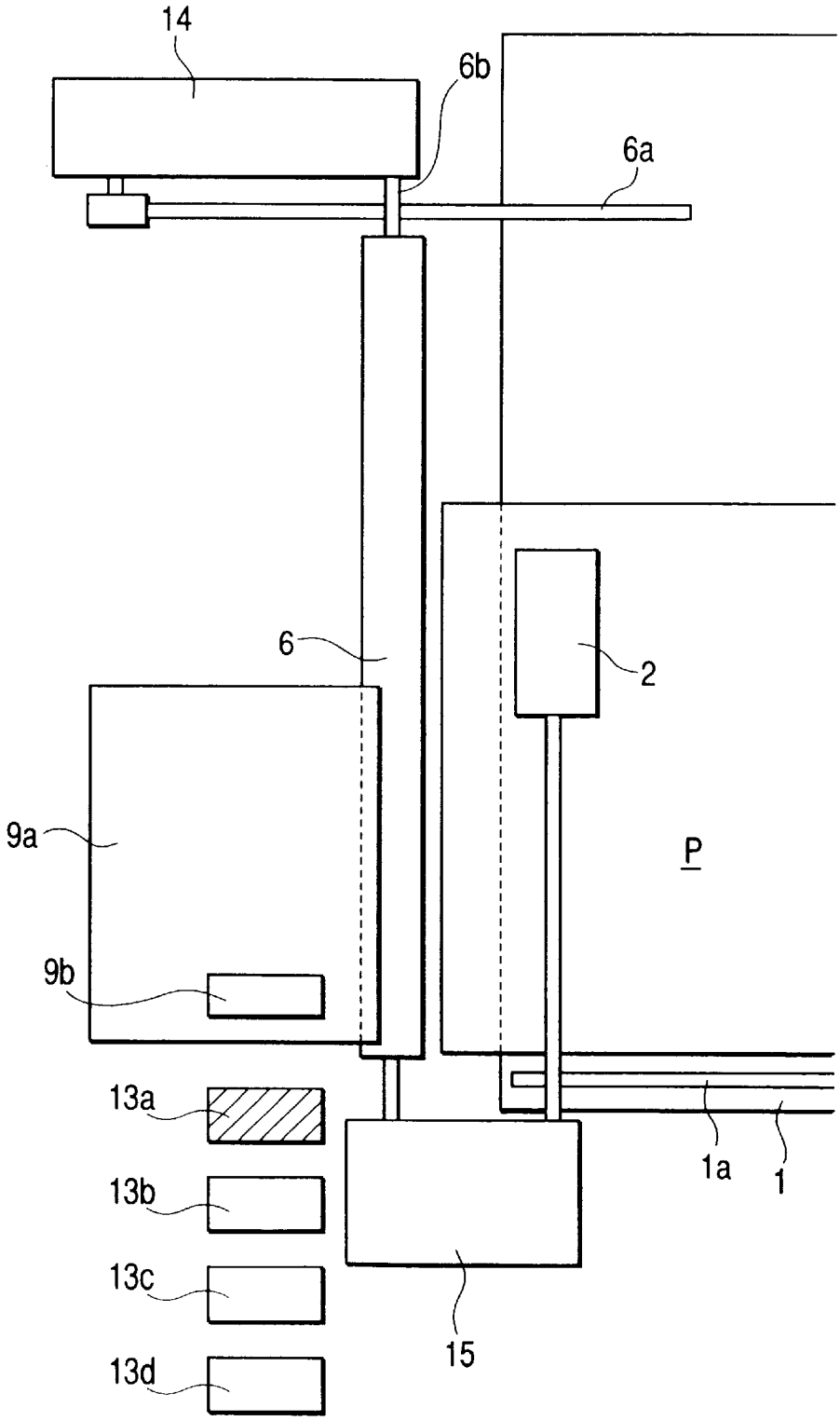
FIG. 2 is a view for explaining a positional relationship of the apparatus in a lateral direction.
Figure 3:
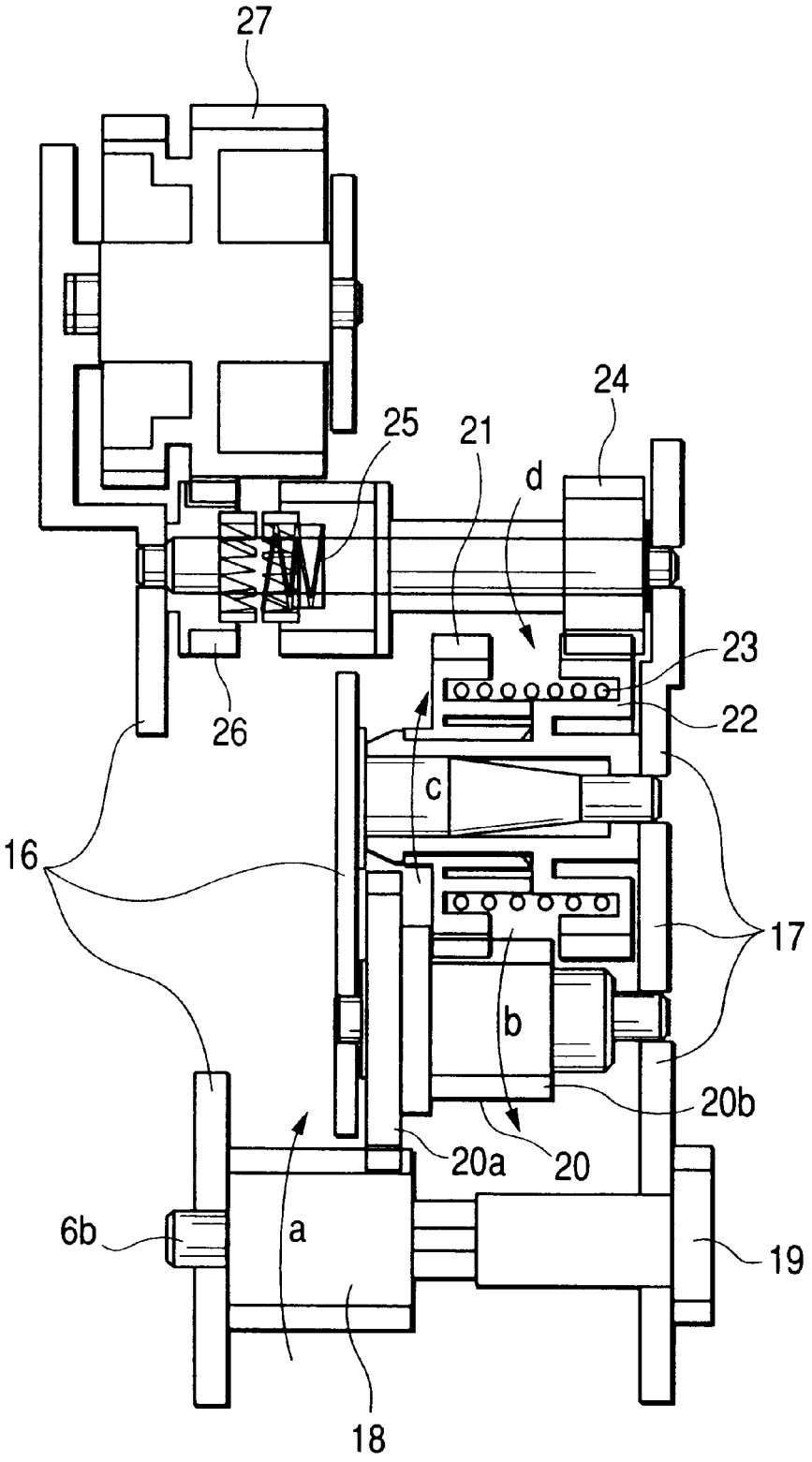
FIG. 3 is a view for explaining a state that drive switching means are rotated forwardly.
Figure 4:
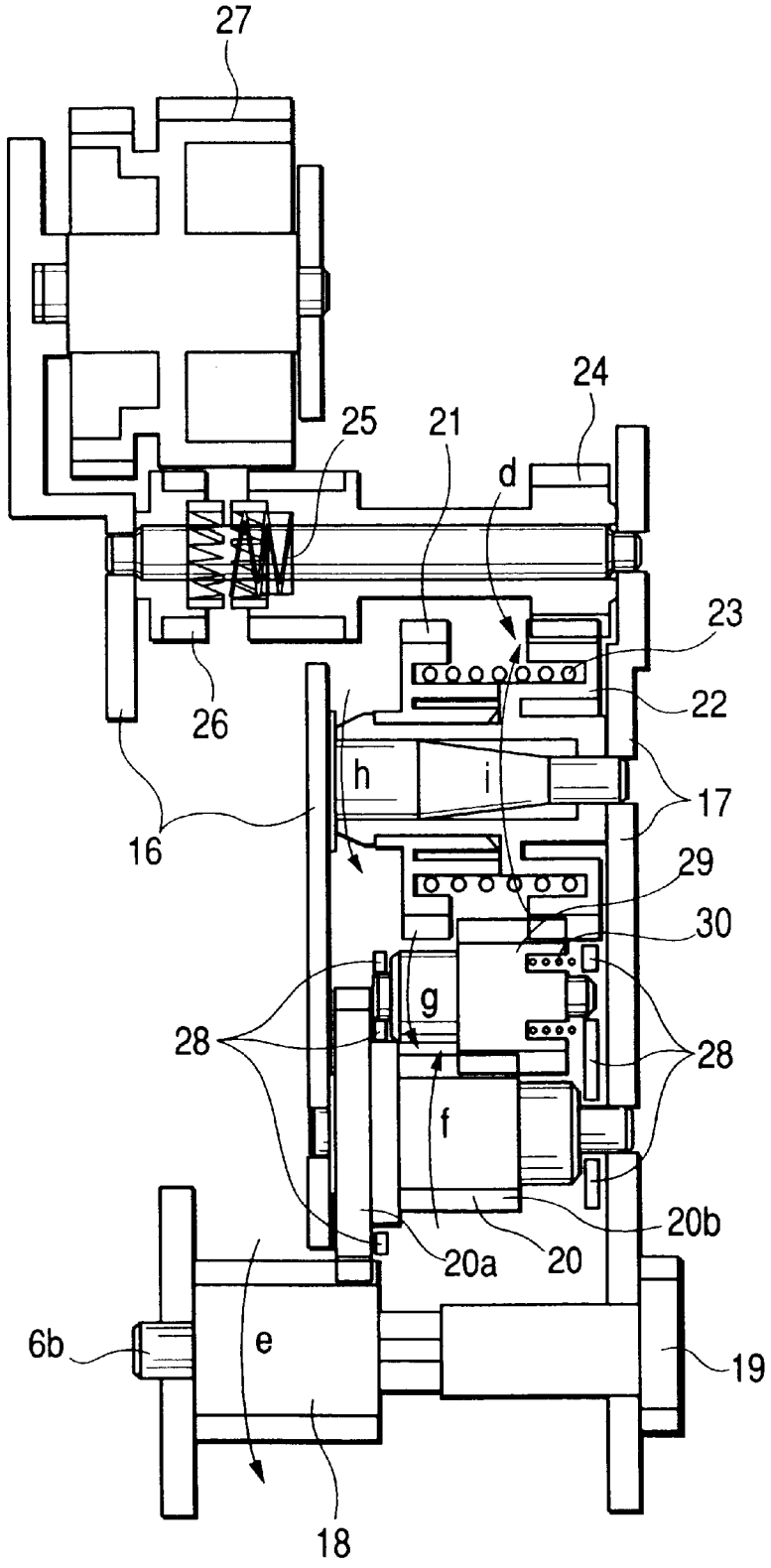
FIG. 4 is a view for explaining a state that the drive switching means are rotated reversely.
Figure 5:
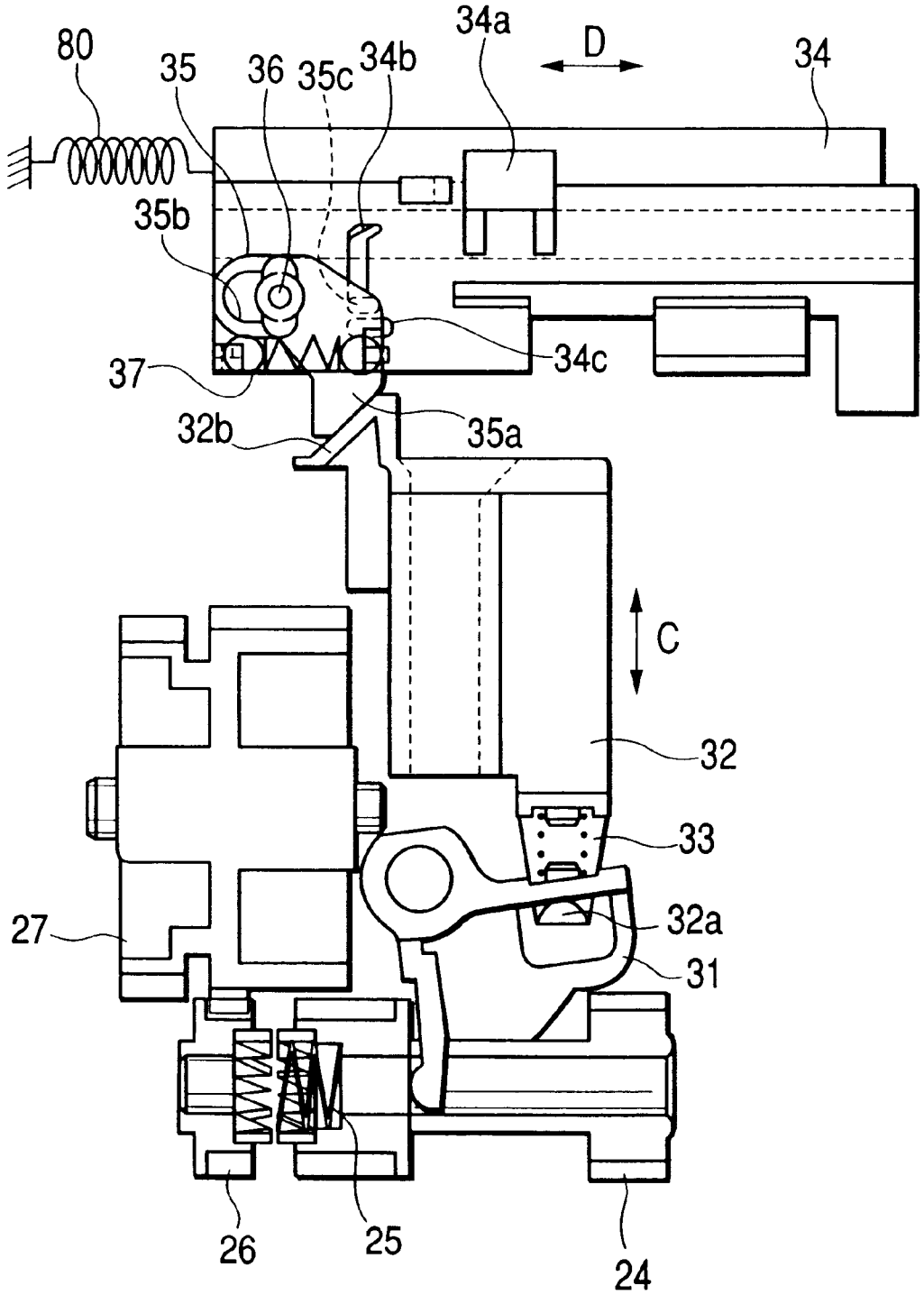
FIG. 5 is a view for explaining an operation of drive intermittent means in recording.
Figure 6:
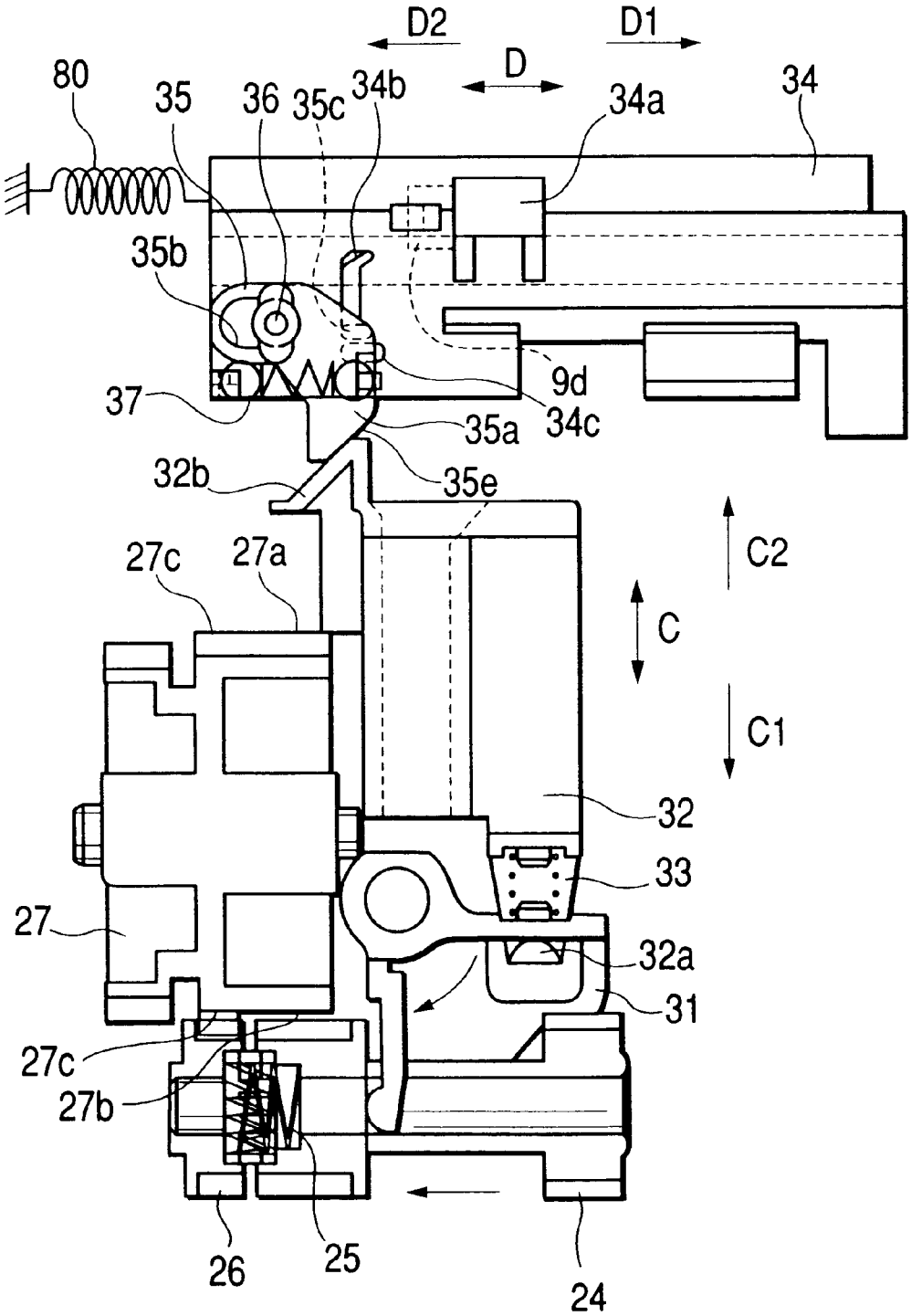
FIG. 6 is a view for explaining the operation of the drive intermittent means being moved to a feeding trigger position.
Figure 7:
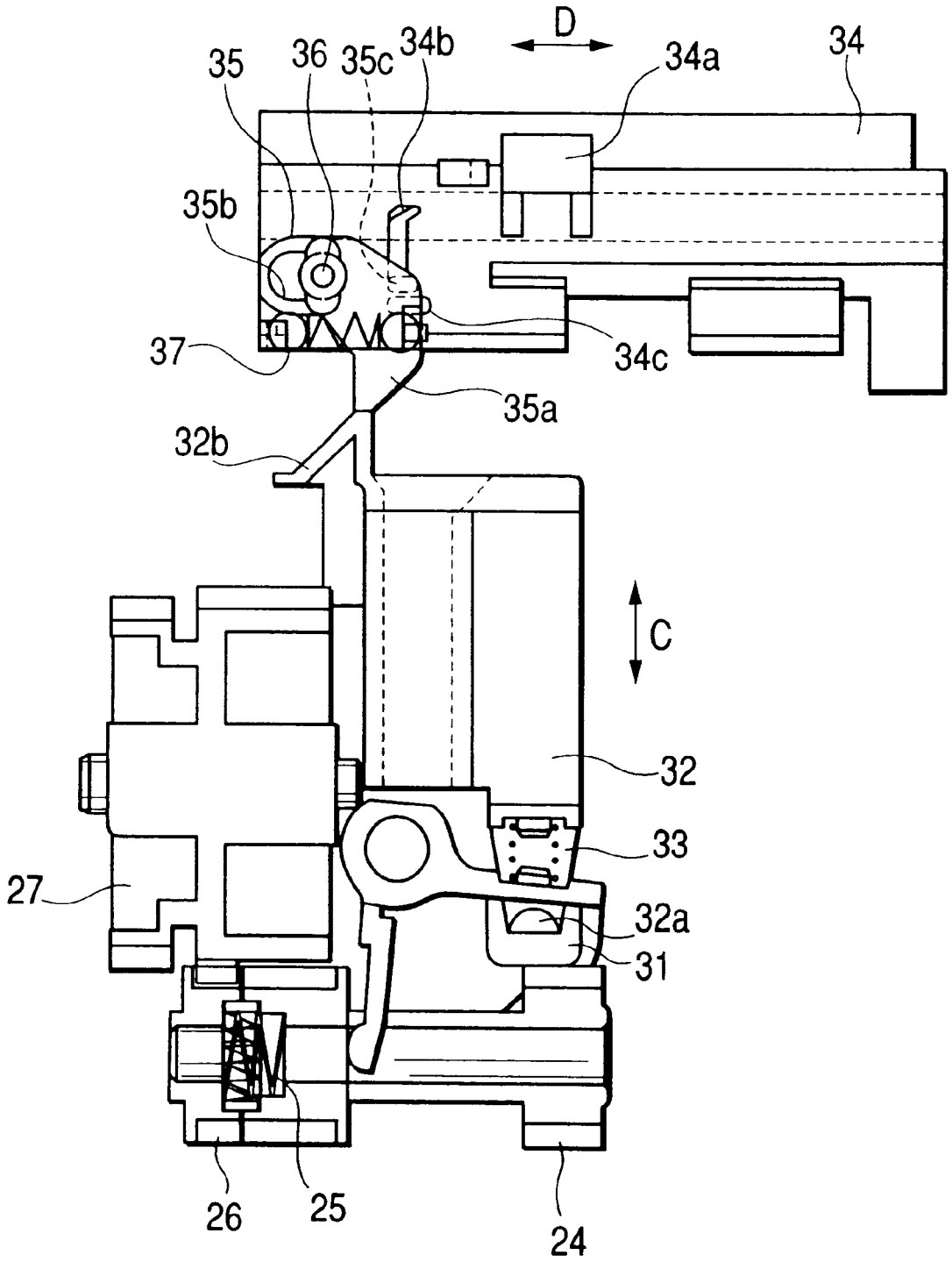
FIG. 7 is a view for explaining the operation of the drive intermittent means in the feeding trigger position.
Figure 8:
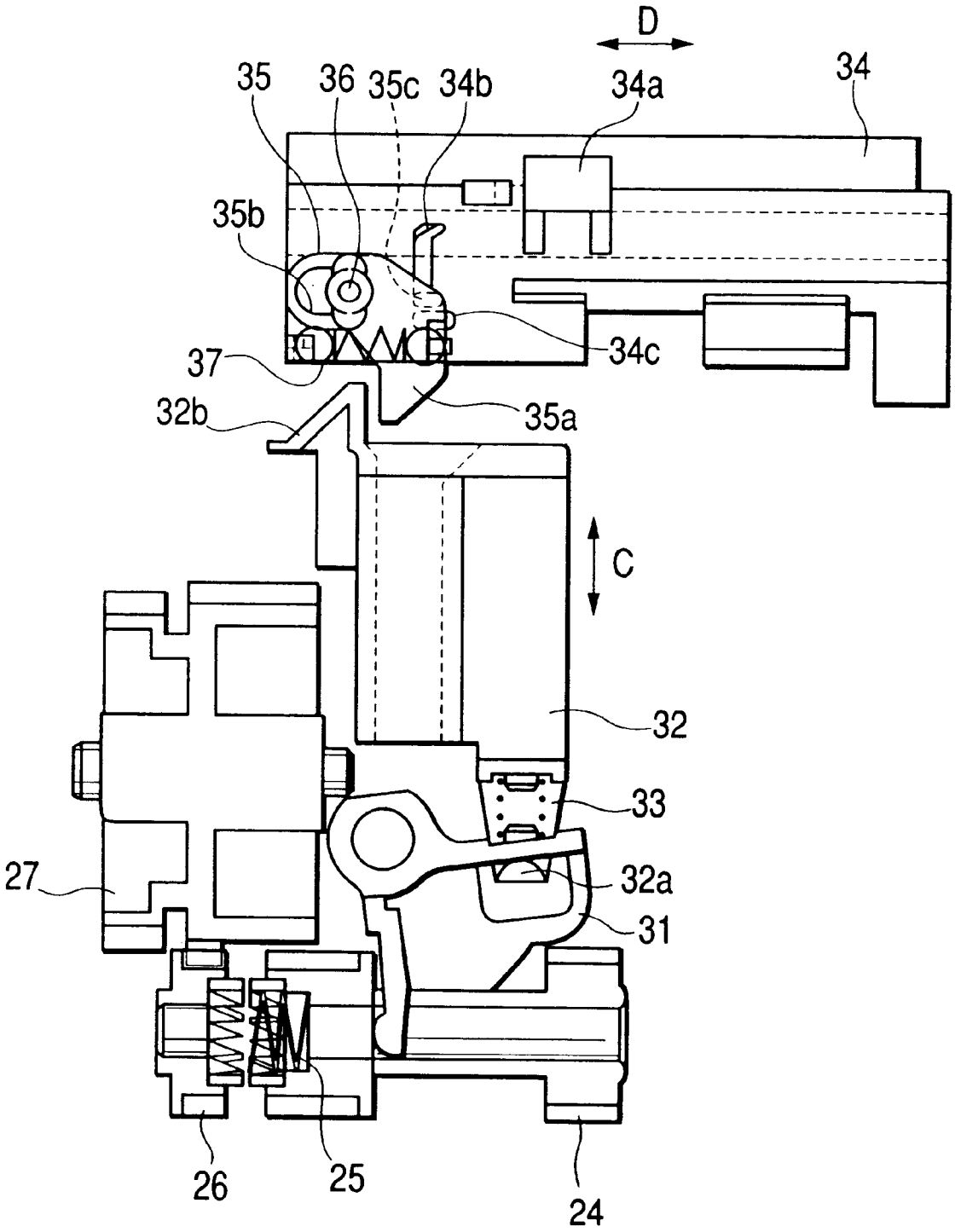
FIG. 8 is a view for explaining the operation of the drive intermittent means in a recovery position.
Figure 9:
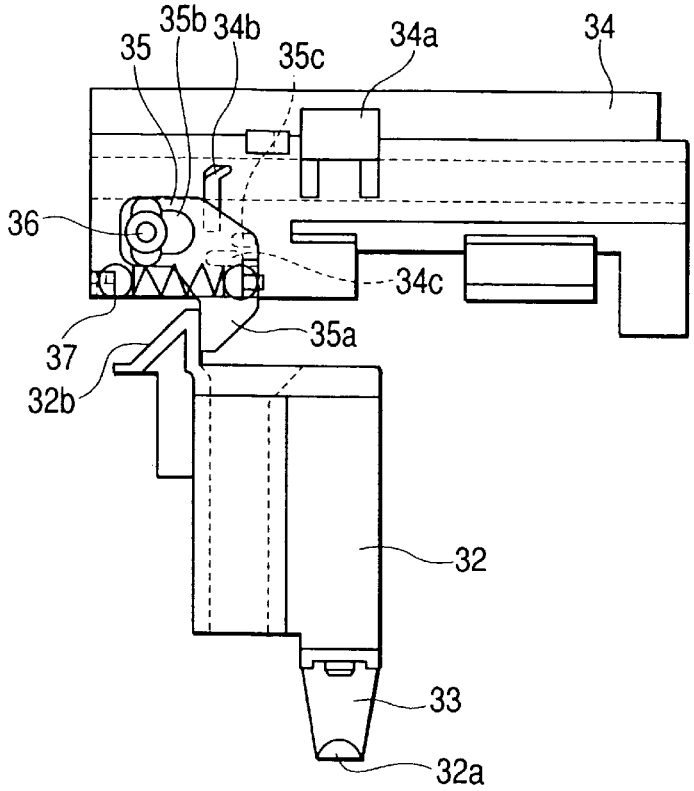
FIG. 9 is a view for explaining the operation of the drive intermittent means disengaged from the recovery position.
Figure 10:
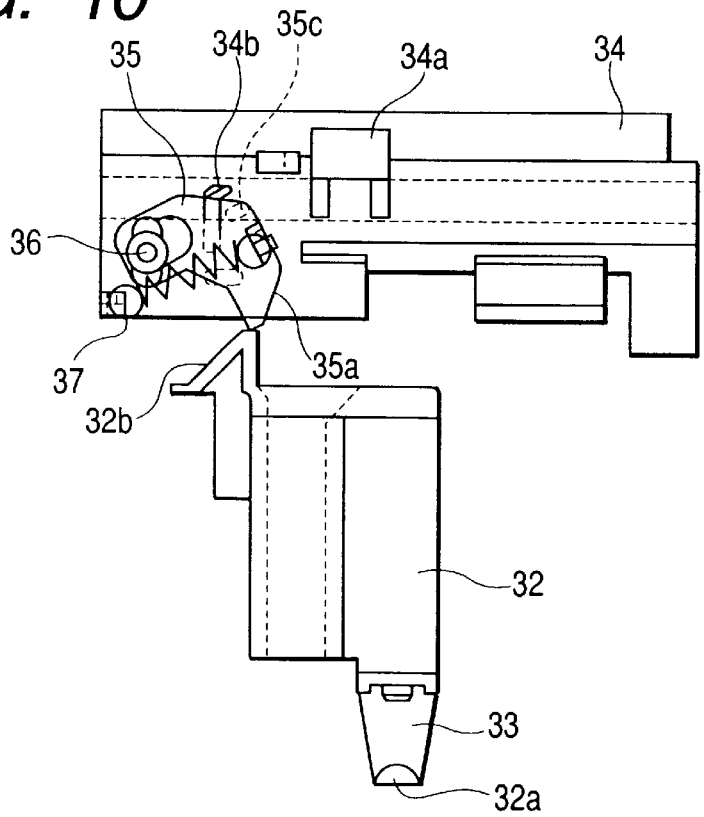
FIG. 10 is a view for explaining the operation of the drive intermittent means disengaged from the recovery position.

FIG. 1 is a view showing an entire construction of an image forming apparatus according to an embodiment of the present invention, FIG. 2 is a view for explaining a positional relationship of the apparatus in a lateral direction, FIG. 3 is a view for explaining a state that drive switching means is rotated forwardly, FIG. 4 is a view for explaining a state that the drive switching means is rotated reversely, and FIGS. 5 to 10 are views for explaining an operation of drive intermittent means, where FIG. 5 shows the drive intermittent means during recording, FIG. 6 shows the drive intermittent means being moved to a feeding trigger position, FIG. 7 shows the drive intermittent means in the feeding trigger position, FIG. 8 shows the drive intermittent means in a recovery position, and FIGS. 9 and 10 show the drive intermittent means disengaged from the recovery position.

In the image forming apparatus according to this embodiment, a spring clutch is used as a one-way clutch when a drive motor is rotated forwardly.

(Entire Construction)

The image forming apparatus shown in FIG. 1 is an ink jet recording apparatus of serial type.

At a rear part of the apparatus, a sheet resting table 1 on which sheets P are stacked is rotatably attached to a body of the apparatus.

The sheet resting table 1 can be moved in an up-and-down direction by a cam (not shown) attached to a feeding roller 2 and, in a normal waiting state, as shown in FIG. 1, the table is lowered to receive the sheets P.

When a recording operation is started, the drive intermittent means (described later) starts drive transmission to the feeding roller 2 to rotate the feeding roller 2 in a forward direction (clockwise direction in FIG. 1, referred to as "forward rotation" hereinafter).

As a result, the cam attached to the feeding roller 2 is also rotated to lift the sheet resting table 1 to abut a sheet stack against the feeding roller 2, thereby starting conveyance of the sheet P.

A separation claw 3 is provided at a lower part of the sheet resting table 1, so that the sheets are separated by cooperation of the feeding roller 2 with the separation claw 3, and the separated sheet is directed to a nip portion between a conveying roller 6 and a conveying runner 7 as a pinch roller through a lower guide 4 and an upper guide 5.

As will be described later, the conveying roller 6 is firstly rotated in a reverse direction (clockwise direction in FIG. 1, referred to as "reverse rotation" hereinafter) to correct a skew-feed of the sheet and then effects the forward rotation to further convey the sheet P.

A platen 8 is disposed opposite to recording means (image forming portion) 9 for forming an image on the sheet P, which platen 8 serves to support a back surface of the sheet P thereby to maintain a distance between the recording means 9 and the sheet P. The recording means 9 includes a recording head 9*b* having a plurality of ink discharge ports arranged in a line along a sheet conveying direction, and a carriage 9*a* capable of being moved while holding the recording head. One-line of the image is recorded by scanning the recording head in a direction (main scanning direction) perpendicular to the conveying direction. Whenever one line image is recorded by the recording means 9, the sheet P is conveyed by the conveying roller 6 by a distance corresponding to one-line. By repeating such procedure, the entire image is recorded on a front surface of the sheet P. The sheet P on which the image has been recorded by the recording means 9 is pinched between a discharge roller 10 and a spur roller 11, thereby discharging the sheet onto a discharge tray 12 while maintaining surface flatness.

Next, the positional relationship of the apparatus in the lateral direction will be explained with reference to FIG. 2. The sheets P are set to abut against a sheet reference 1*a* disposed on this side on the sheet resting table 1. The reason is that a moving distance of the carriage 9*a* is shortened (i.e., through-put is improved) since the image is normally recorded on the sheet with aligning the image to the left. Further, a preliminary dispensing position 13*a* is provided at a pre-record waiting position where the recording means 9 is positioned off the sheet toward this side of the sheet P. In case of the ink jet recording, in order to avoid poor recording due to drying of the recording head 9*b*, it may be required that the preliminary dispensing be effected out of the sheet whenever line-space and page change are performed. Accordingly, the preliminary dispensing position 13*a* is also located near the sheet reference 1*a* to improve the through-put.

A feeding trigger position 13*b* (described later) is located on this side of the preliminary dispensing position 13*a*. The feeding trigger position 13*b* is a position of the carriage 9*a* when the feeding of the sheet is started by the feeding roller 2. Accordingly, a drive transmitting mechanism 15 for transmitting a driving force to the feeding roller 2 is also disposed near the feeding trigger position. A recovery and cap position 13*c* is located on this side of the feeding trigger position 13*b,* and a recovery unit 13*d* is disposed in the vicinity of the recovery and cap position 13*c*. That is to say, these positions and elements are arranged in order from the sheet P in such a manner that the greater the frequency of usage thereof the nearer the sheet.

Since the preliminary dispensing position 13*a,* the feeding trigger position 13*b* and the recovery and cap position 13*c* are positioned on this side in FIG. 2, a drive motor 14 and a driving system for the conveying roller 6 are located on that side corresponding to the opposite side of the sheet P. As mentioned above, since the conveying accuracy of the conveying roller 6 is important, drive intermittent means such as a clutch is not disposed in a drive transmitting path from the drive motor (drive source) 14. Further, similarly, in order to improve the feeding accuracy, a gear 6*a* for the conveying roller 6 has a great number of teeth and therefore has a great diameter. Thus, since the gear 6*a* protrudes from the sheet surface, it is disposed out of a movement range of the carriage 9*a*. On the other hand, as mentioned above, since the drive transmitting mechanism 15 for the feeding roller 2 is disposed on this side of the sheet, the driving force is transmitted to the feeding roller 2 through the conveying roller 6.

Next, the up-and-down direction will be explained. Since preliminary dispensing ports of the preliminary dispensing position 13*a* and the recovery unit 13*d* must be positioned opposite to the recording head 9*b,* they are situated below the sheet conveying plane. Further, in consideration of exchange of the recording head 9*b* and an ink tank (not shown), it is desirable that an opening portion is provided in front of the carriage 9*a* (on the left side in FIG. 1). To this end, it is desirable that a drive system for the carriage 9*a* including a moving guide 9*c* is disposed at a back surface side (on the right side in FIG. 1) of the carriage 9*a*. Accordingly, it is desirable that the drive transmitting mechanism 15 is also disposed below the carriage 9*a,* similar to the recovery unit 13*d*.

(Drive Transmitting Mechanism)

Next, the drive transmitting mechanism 15 will be explained. The drive transmitting mechanism 15 includes drive switching means for rotating the feeding roller 2 in one direction regardless of the rotational direction of the drive motor 14, and drive intermittent means for selectively transmitting the driving force from the drive motor 14 to the feeding roller 2. Now, these means will be described.

(Drive Switching Means)

FIG. 3 is a development view showing the drive switching means when th e conveying roller is rotated forwardly, and FIG. 4 is a development view showing the drive switching means when the conveying roller is rotated reversely. The actual three-dimensional arrangement differs from the arrangement shown in FIGS. 3 and 4. In the drive switching means, various gears are supported by frames 16, 17.

In FIG. 3, an input gear 18 to the drive switching means and an output gear 19 to the recovery unit 19 are attached to a conveying roller shaft 6*b*. As mentioned above, the conveying roller shaft 6*b* is directly connected to the drive motor 14 to be rotated forwardly and reversely. Upon forward rotation, the shaft 6*b* is rotated in a direction indicated by the arrow a in FIG. 3. A large diameter gear 20*a* of a speed reduction sun gear 20 is meshed with the input gear 18 and is rotated in a direction indicated by the arrow b in FIG. 3. A spring clutch input gear 21 is meshed with a small diameter gear 20*b* of the speed reduction sun gear 20.

A spring clutch output gear 22 including a second rotary member is disposed coaxially with the spring clutch input gear 21 including a first rotary member, and a spring clutch (coil spring) 23 is mounted between the gears 21 and 22 to form a one-way clutch. The spring clutch 23 is designed to effect drive transmission only when it is rotated in a direction indicated by the arrow c, and the spring clutch input gear 21 and the spring clutch output gear 22 are rotated in the same direction in synchronous with each other. The spring clutch output gear 22 is meshed with a clutch trigger gear (second gear) 24 to rotate the clutch trigger gear 24 in a direction indicated by the arrow d.

The driving force transmitted to the clutch trigger gear (clutch means) 24 is intermittently transmitted to a clutch gear (third gear) 26 through a clutch separation spring 25 and then is transmitted to an output gear 27 (first gear) for the feeding roller 2. This drive intermittent transmission is effected by the drive intermittent means which will be described later.

In FIG. 4, the conveying roller shaft 6*b* and the input gear 18 are rotated reversely, i.e., in a direction indicated by the arrow e, thereby rotating the speed reduction sun gear 20 in a direction indicated by the arrow f. A pendulum arm 28 for supporting a planetary gear 29 is rotatably fitted on the speed reduction sun gear 20 so that the planetary gear 29 is always meshed with the small diameter gear 20*b* and applies rotational load to the pendulum arm 20 through a side pressure spring 30 disposed between the pendulum arm 28 and the planetary gear 29. With this arrangement, when the speed reduction sun gear 20 is rotated in the direction f, the pendulum arm 28 is rocked, with the result that the spring clutch output gear 22 is engaged with the planetary gear 29 to transmit the driving force, thereby rotating the spring clutch output gear 22 in a direction indicated by the arrow i. Incidentally, when the speed reduction sun gear 20 is rotated in the direction indicated by the arrow b in FIG. 3, the planetary gear 29 is separated from the spring clutch output gear 22 so that the driving force is not transmitted.

When the driving force is transmitted to the spring clutch output gear 22 by the planetary gear 29, the spring clutch output gear 22 is rotated in the direction opposite to a rotational direction of the spring clutch input gear 21 (although not shown, in actual, the spring clutch input gear 21 is meshed with the small diameter gear 20*b* similar to FIG. 3 to be rotated in a direction indicated by the arrow h). However, since the spring clutch 23 is rotated in the direction along which the driving force is not transmitted, the drive transmission from the spring clutch input gear 21 rotating in the direction indicated by the arrow h to the spring clutch output gear 22 is not effected.

In this way, even when the conveying roller 6 is rotated reversely, the rotational driving force in the direction indicated by the arrow d similar to the forward rotation is transmitted to the clutch trigger gear 24, with the result that the forward rotational driving force is always transmitted to the feeding roller 2.

When the sheet is fed by using the above-mentioned drive switching means, first of all, the conveying roller 6 is rotated reversely, and the feeding roller 2 is rotated forwardly by the pendulum arm 28. As a result, even if the sheet P being fed is skew-fed, the skew-feed can be corrected by abutting the leading end of the sheet against the nip between the conveying roller 6 and the conveying runner 7. In this case, the excessive feeding amount is absorbed by flexing the sheet P, or by causing slip between the conveying roller 6 and the sheet P in dependence upon the rigidity of the sheet or the conveying force of the feeding roller 2. Further, by detecting a leading end position of the sheet by a sheet leading end sensor 5*a,* the excessive feeding amount is controlled to about 3 mm.

When a predetermined amount is fed excessively, the rotational direction of the drive motor 14 is switched to rotate the conveying roller 6 forwardly, thereby nipping the sheet P between the conveying roller 6 and the conveying runner. In this case, if the sheet P is flexed, the nipping can easily be attained by a repulsive force of the sheet. However, if the excessive feeding amount is absorbed due to the slip between the conveying roller 6 and the sheet P, such a repulsive force cannot be obtained.

However, in the above-mentioned arrangement, when the pendulum arm 28 is separated from the spring clutch output gear 22, the driving force is transmitted to the feeding roller 2 immediately by the spring clutch 23 so that the feeding roller 2 can start to be rotated substantially at the same time as the forward rotation of the conveying roller 6. Accordingly, the sheet P can be pushed by the feeding roller 2 without any time lag, with the result that the conveyance of the sheet can be securely and accurately started without deviation in the leading end position of the sheet and difference in the sheet position between the left and the right sides of the sheet.

Incidentally, in the illustrated embodiment, while an example that the spring clutch 23 is used as the clutch when the reverse rotation is switched to the forward rotation is explained, the present invention is not limited to such an example, but a one-way clutch of needle type capable of achieving quick switching can be used similarly.

(Drive Intermittent Means)

Next, the drive intermittent means or trigger means will be explained with reference to FIGS. 5 to 10.

The drive intermittent means serves to connect or disconnect the clutch gear 26 to selectively transmit the driving force from the clutch trigger gear 24 to the feeding roller 2.

As mentioned above, the clutch trigger gear 24 is arranged to be rotated forwardly regardless of the rotational directions of the drive motor 14 and the conveying roller 6.

The clutch trigger gear 24 can be moved to be connected with and disconnected from the clutch gear 26 disposed coaxially with the clutch trigger gear 24 and having the same number of teeth as that of the clutch trigger gear 24.

Sawtooth faces (engagement portions) are formed on opposed end surfaces of the clutch trigger gear 24 and the clutch gear 26 respectively. And, the clutch function is achieved by effecting engagement and disengagement between both sawtooth faces.

Figure 11:
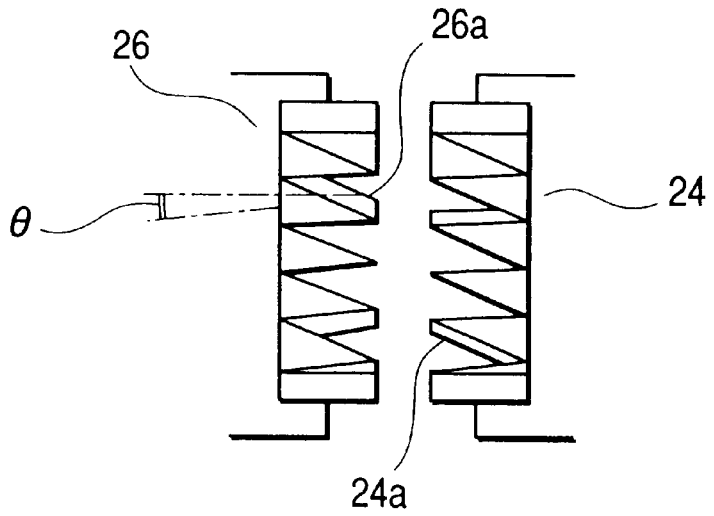
FIG. 11 is an enlarged view of clutch teeth of a clutch gear and a clutch trigger gear constituting a drive transmitting unit.

Incidentally, because of unidirectional rotational transmission, as shown in FIG. 11, at the rotational transmission side, the clutch teeth 24*a,* 26*a* are inclined by a predetermined angle of θ (about 5 degrees) with respect to the engagement/disengagement direction of the clutch trigger gear 24.

As a result, with a very simple arrangement, the disengagement of the clutch can surely be achieved, and a separating force due to transmission can be reduced and a biasing force of a stroke absorbing spring 33 can be minimized, and, further, an operating force of an actuator 34 can be reduced.

Further, since surfaces opposed to the clutch teeth 24*a,* 26*a* do not contribute to the drive transmission, these surfaces are inclined as much as possible, as shown in FIG. 11.

With this arrangement, the strength of the clutch teeth 24*a,* 26*a* can be increased and the disengagement of the clutch can be ensured, and tip end surfaces of the clutch teeth are minimized to minimize the possibility of encountering between the tip end surfaces of the clutch teeth 24*a,* 26*a*.

The clutch separating spring 25 is provided in the clutch trigger gear 24 to bias the clutch trigger gear 24 away from the clutch gear 26.

The clutch separating spring 25 serves to maintain the disengagement between the clutch trigger gear 24 and the clutch gear 26, and a slide member 32 and a link member 31 constituting moving means are maintained in normal positions by the clutch separation spring 25.

A circumferential gear portion 27*c* of an output gear 27 is meshed with the clutch gear 26, so that the driving force is transmitted to the feeding roller 2 coaxial with the output gear 27.

Further, the output gear 27 is provided at its end with a partially toothless gear portion 27*a* meshed with the clutch trigger gear 24. The output gear 27 and the clutch trigger gear 24 are assembled in phase so that, when a toothless portion 27*b* of the partially toothless gear portion 27*a* is opposed to the clutch gear 24, the feeding roller 2 becomes a waiting state. The output gear 27 and a gear on a shaft of the feeding roller 2 have the same number of teeth so that the driving force is transmitted without speed reduction.

The link member (rotary member) 31 is rotatably supported so that it is rotated while abutting its one end against the clutch trigger gear 24 to move the clutch trigger gear 24 to engage the gear 24 with the clutch gear 26. The slide member (moving member) 32 capable of being moved in a direction indicated by the arrow C in FIG. 5 is connected to the link member 31 so that the link member 31 can be rotated by a sliding movement of the slide member 32. The stroke absorbing spring (elastic deformable portion) 33 is disposed between the link member 31 and the slide member 32 to bias these members away from each other. Further, the slide member 32 is provided at its tip end with an engaging portion (cam member) 32*a* so that the slide member 32 is not separated from the link member 31 by a distance greater than a predetermined distance.

Although the slide member 32 is operated in association with the operation of the carriage 9*a,* in view of the internal arrangement of the image forming apparatus, it is difficult to design that the carriage 9*a* directly acts on the slide member 32. Thus, the actuator (engagement means) 34 is provided so that the carriage 9*a* indirectly acts on the slide member 32 by pushing the actuator 34 by a part of the carriage 9*a,* thereby providing the feeding trigger.

The actuator 34 can be moved in the same direction (indicated by the arrow D) as the scanning direction of the carriage 9*a* and has a protruded engagement portion 34*a* to be engaged with the carriage 9*a*. The actuator 34 is biased toward that side of the apparatus (left side in FIG. 5) by a coil spring (biasing means) 80 and is stopped by a stopper (not shown). By biasing in this way, when the carriage 9*a* is moved toward that side of the apparatus, the actuator 34 can be returned to its waiting position. To the contrary, when the drive intermittent means are operated and if the carriage 9*a* is positioned on this side of the preliminary dispensing position 13*a,* the actuator 34 is also positioned on this side of the apparatus and the coil spring (biasing means) 80 is extended.

A latch member (urging member or cam) 35 abutting against a cam 32*b* of the slide member 32 is attached to the actuator (support member) 34. An abutment portion 35*a* of the latch member 35 abutting against the cam 32*b* is formed as an inclined surface. An elongated hole 35*b* formed in the latch member 35 is loosely fitted on a shaft portion 36 formed on the actuator 34 so that the latch member 35 can be moved in a moving direction of the actuator 34 by an amount corresponding to play of the elongated hole and can be rotated. Further, the latch member 35 is biased by a spring 37 toward that side (left side in FIG. 5) of the apparatus and toward the slide member 32 (clockwise direction in FIG. 5)

to be moved toward that side of the apparatus by the amount corresponding to the play of the elongated hole loosely fitted on the shaft portion 36. In this position, an engagement portion 35*c* formed on a back surface of the latch member 35 is regulated in an up-and-down direction by protruded portions (engagement portions) 34*b,* 34*c* formed on the actuator 34, thereby stopping the latch member stably.

FIG. 5 shows a state that the carriage 9*a* is positioned at the preliminary dispensing position 13*a* (FIG. 2) or at a recording position, where the drive intermittent means are not operated. Accordingly, in this state, when the conveying roller 6 is rotatingly driven, although the clutch trigger gear 24 is rotated forwardly, the driving force is not transmitted to the clutch gear 26. Similarly, the toothless portion of the output gear 27 is opposed to the clutch trigger gear 24, so that the driving force is not transmitted. From these fact, the feeding roller 2 is not rotated but is stopped.

FIG. 6 shows a state that the carriage 9*a* is being moved toward the feeding trigger position 13*b*. When the carriage 9*a* approaches from the preliminary dispensing position 13*a* to the feeding trigger position 13*b,* the abutment portion 9*d* of the carriage 9*a* abuts against the abutment portion 34*a* of the actuator 34 to move the actuator 34 toward this side (right in FIG. 6) of the apparatus together with the carriage 9*a,* thereby abutting the inclined surface of the abutment portion 35*a* of the latch member 35 against the inclined surface of the cam (follower portion) 32*b* of the slide member 32. Although a leftward and upward force acts on the latch member 35, the latch member 35 is not moved with respect to the actuator 34 because the elongated hole 35*b* abuts against the shaft portion 36 in the left direction and because the engagement portion 35*c* abuts against the protruded portion 34*b* in the upward direction. In this case, the spring 37 of the latch member 35 is not subjected to any load, no action is caused by the spring 37, but, only the position of the latch member 35 is determined by the spring 37.

On the other hand, a rightward and downward force acts on the slide member 32 to move the slide member 32 along the guide in a direction indicated by the arrow C1. This movement is transmitted to the link member 31 through the stroke absorbing spring 33, with the result that the link member 31 is rotated in a clockwise direction in FIG. 6. Further, this movement is transmitted to the clutch trigger gear 24, with the result that the clutch trigger gear 24 is moved against the biasing force of the clutch separation spring 25. When the carriage 9*a* is further moved to this side of the apparatus, it reaches the feeding trigger position 13*b*.

FIG. 7 shows a state that the carriage 9*a* is in the feeding trigger position 13*b*. In this case, a distal end of the abutment portion 35*a* of the latch member 35 reaches a top of the cam 32*b* of the slide member 32 and therefore the moving amount of the slide member 32 becomes maximum. The clutch trigger gear 24 abuts against and is engaged with the clutch gear 26 completely, thereby transmitting the driving force to the feeding roller 2.

An abutting or urging amount in this case is set to be greater than the actual gap. This is because the engagement between the clutch trigger gear 24 and the clutch gear 26 is ensured even when there is dispersion in the moving amount due to difference from elements to elements of the apparatus. The over-stroke amount is absorbed by compression of the stroke absorbing spring 33 disposed between the slide member 32 and the link member 31, thereby not obstructing the movement of the actuator 34. Incidentally, if the top of the tooth 24*a* of the clutch trigger gear 24 abuts against the top of the tooth 26*a* of the clutch gear 26 during the downward movement of the actuator 34, the clutch trigger gear 24 cannot be moved. However, the movement of the actuator 34 is not obstructed due to the presence of the stroke absorbing spring 33. Further, in this state, when the conveying roller is rotated, the tops of teeth 24*a,* 26*a* are slipped relative to each other to achieve the proper engagement between the teeth 24*a,* 26*a*. Also in this case, the slip is caused with moderate elastic force, and the clutch engagement is attained by such elastic force.

In this state, when the drive motor 14 is rotated forwardly and then reversely, the rotation of the motor is transmitted from the clutch trigger gear 24 to the output gear 27 through the clutch gear 26 to start the rotation of the feeding roller 2. When the feeding roller 2 is rotated by a small amount, the toothless portion of the output gear 27 leaves the position opposed to the clutch trigger gear 24, with the result that the output gear 27 is engaged with the clutch trigger gear 24 directly, thereby transmitting the driving force. Accordingly, even if the carriage 9*a* leaves the feeding trigger position 13*b* (for example, the carriage 9*a* is moved to the preliminary dispensing position 13*a*), the drive transmission to the feeding roller 2 is continued. The feeding trigger is finished in this way, and the rotational driving through one revolution is transmitted to the feeding roller 2.

Although the reason why the above-mentioned arrangement is provided is that the required operation of the carriage is previously performed to enhance the through-put, there are also other reasons which will be described hereinbelow.

After the feeding roller 2 starts to be rotated, the load is generated except for a period in that the sheet resting table 1 is being lifted in the initial period of rotation and a period of pre-rotation (described later) immediately before one revolution is completed.

That is to say, the load is also generated between the tooth surfaces of the output gear 27 and the tooth surfaces of the clutch trigger gear 24, with the result that the friction force between the tooth surfaces makes it difficult to separate the clutch trigger gear 24 from the clutch gear 26 only by the biasing force of the clutch separation spring 25.

Consequently, the drive transmission cannot be disconnected regardless of the fact that the carriage 9*a* is not positioned at the feeding trigger position 13*b* thereby to start second revolution, thereby causing the erroneous operation.

To avoid this, it is important that the carriage 9*a* be escaped in the period in which no load as mentioned above is generated before the lifting of the sheet resting table 1.

Accordingly, it is desirable that there be provided a waiting position detecting sensor for the feeding roller 2 and a timing for escaping the carriage 9*a* be accurately determined on the basis of a detection result.

The reason is that, since it is not determined which teeth contribute to the clutch engagement and the clutch naturally achieves only the intermittent engagement, it is difficult to determine such timing by step control or time control.

Further, although judgement for judging whether a special sequence to be performed if a position of the leading end of the sheet P cannot be determined due to sheet separation effected by the semi-circular feeding roller 2 should be performed or not is effected by measuring the number of steps from an initiation of the feeding to a time when the sheet enters into the sheet leading end sensor 5*a,* similarly, since dispersion is generated due to the error of the clutch portion, it is desirable that the detecting timing of the sheet leading end sensor 5*a* is measured on the basis of the waiting position detecting sensor for the feeding roller 2.

Figure 12:
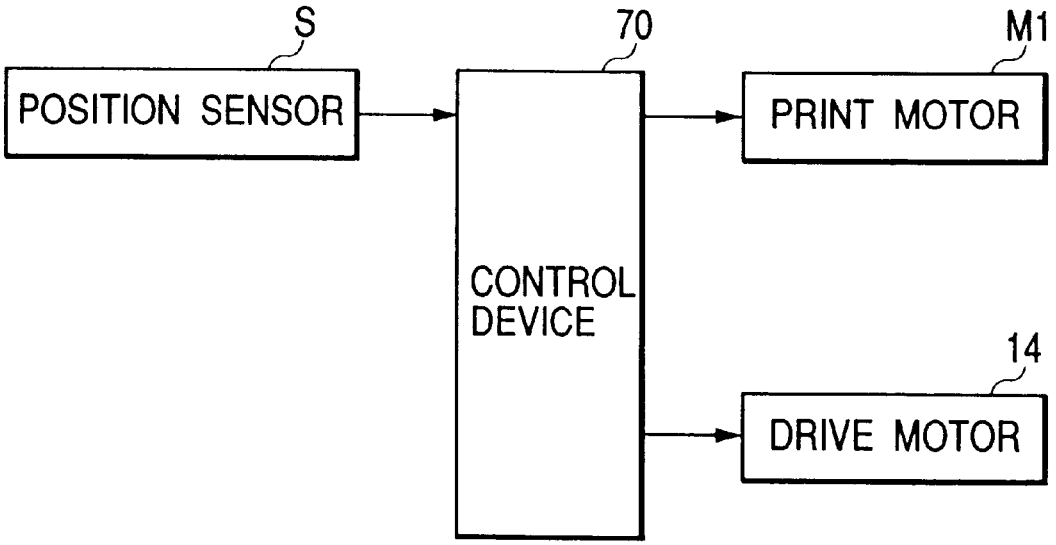
FIG. 12 is a view showing a part of control block of a control device of an ink jet printer apparatus.

The detection signal of the position sensor S is inputted to a control device (control means) 70 (FIG. 12) provided at a predetermined position in the main body of the apparatus, so that the control device 70 drives a print motor M1 as a moving motor for moving the recording head portion at least before the sheet on the sheet resting table lifted in association with the rotation of the feeding roller abuts against the feeding roller on the basis of the detection signal of the position sensor S, thereby escaping the actuator 34 (carriage).

It should be understood that phases of the gear teeth formed on the outer peripheries of the clutch trigger gear 24 and the clutch gear 26 are substantially aligned with the phase of the clutch teeth. Explaining more specifically, when the peripheral gears are mated with each other, slight gap is created in the clutch.

When the drive transmission is effected by the clutch teeth, slight deviation is generated between the peripheral gears. However, there is no problem so long as the gears can be engaged with each other after passing through the toothless portion.

This has a purpose for interrupting a transmission path between the clutch trigger gear 24, the clutch gear 26 and the output gear 27 after the transmission is maintained by the output gear 27 and the clutch trigger gear 24.

Similar to the above, this prevents the disengagement of the clutch trigger gear 24 from the clutch gear 26.

Incidentally, in the illustrated embodiment, although it is described that the input of the driving force to the clutch portion is effected by the clutch trigger gear 24 which is slidingly moved, essentially, it is desirable that the input of the driving force is transmitted to the clutch gear 26 which is not moved. In this case, since the drive transmission of the clutch trigger gear 24 can be interrupted only by effecting out-of-phase of the clutch teeth with respect to the peripheral gear teeth, the operation becomes more effective.

In the state that the clutch trigger gear 24 is meshed with the output gear 27, when the drive motor 14 is further rotated, the output gear 27 and the feeding roller 2 are rotated through one revolution in a short time. As a result, the toothless portion of the output gear 27 is opposed to the clutch trigger gear 24 again, thereby finishing the drive transmission and also finishing the rotation of the feeding roller 2. Before one revolution is completed, the feeding roller 2 lowers the sheet resting table 1 via a cam (not shown). In this case, it is designed so that excessive lowering is once attained to slide the cam downwardly along an inclined surface, thereby reaching the stable waiting position.

The reason is that a disadvantage caused when a mechanism in which one revolution is controlled by the above-mentioned toothless portion is used is eliminated. Such a disadvantage is that, if the toothless portion is reached while the load is acting on the feeding roller 2, the toothless portion is returned due to deflection occurred in the driving system and the like, with the result that the teeth adjacent to the toothless portion of the output gear 27 and the teeth of the clutch trigger gear 24 may not be easily disengaged from each other, thereby generating noise. However, when the above-mentioned cam arrangement is utilized, the feeding roller 2 is pre-rotated regardless of the driving force of the driving system, by the cooperation of the inclined surface of the cam and the upward biasing force of the sheet resting table 1 so that the toothless portion is also rotated to ensure the disengagement of the teeth. Incidentally, by providing a similar mechanism in the output gear 27 or other gear for effecting the transmission to the feeding roller 2, similar effect can be achieved.

After the feeding roller 2 is rotated through one revolution, the conveying roller 6 is rotated forwardly or reversely to position the recording position, and, then, the recording operation is started. This is because it is necessary to reduce the influence of the feeding roller 2 as the conveyance accuracy of the conveying roller 6 is important.

FIG. 8 shows a state that the carriage 9*a* is reached to the recovery and cap position 13*c* after the carriage 9*a* is moved toward this side (right in FIG. 8) of the apparatus from the feeding trigger position 13*b*. Since the recovery unit and the cap are operated by the driving force of the drive motor 14, even in this position, it is required that the cam 32*b* for the feeding trigger be not pushed.

As shown in FIG. 8, when the actuator 34 is further moved toward this side of the apparatus, the abutment portion 35*a* of the latch member 35 gets over the cam 32*b* of the slide member 32 to reach this side of the apparatus. After the latch member 35 gets over the cam 32*b*, the clutch trigger gear 24, the link member 31 and the slide member 32 are restored to their waiting positions by the biasing force of the clutch separation spring 25, with the result that, if the drive motor 14 is driven, the feeding trigger does not occur. Incidentally, when the latch member 35 is passed through the cam 32*b*, the slide member 32 is pushed downwardly as mentioned above. However, in this case, so long as the drive motor 14 is not driven, the latch member can be passed without causing the feeding trigger.

As shown in FIG. 9, when the carriage 9*a* is moved from the recovery and cap position 13*c* to that side of the apparatus, the actuator 34 tries to return to the waiting position by the aforementioned biasing means (not shown). In this case, the left side surface of the abutment portion 35*a* of the latch member 35 abuts against the right side surface of the cam 32*b* of the slide member 32, and this position of the latch member 35 is maintained against the biasing force of the spring 37, thus the latch member 35 is moved to this side of the apparatus with respect to the actuator 34. Incidentally, the biasing force of the spring 37 is selected to be sufficiently smaller than the biasing force (not shown) applied to the actuator 34. Meanwhile, since the engagement portion 35*c* on the back surface of the latch member 35 and the protruded portions 34*b*, 34*c* of the actuator 34 do not interfere with each other because of the horizontal movement.

When the latch member 35 is moved in this way, the engagement portion 35*c* is released from the regulation of the protruded portions 34*b*, 34*c*, with the result that the latch member 35 can be rotated in the direction (anti-clockwise direction in FIG. 9) for escaping from the cam 32*b* and is biased toward the clockwise direction only by the spring 37. When the actuator 34 is further moved to the left, the actuator 34 is moved by a distance corresponding to the length of the elongated hole 35*b*, and the latch member 35 is rotated in the anti-clockwise direction against the biasing force of the spring 37 to eventually reach a height where the latch member 35 can get over the slide member 32, as shown in FIG. 10. When the actuator 34 is further moved to the left, the latch member 35 gets over the slide member 32 completely. Thereafter, the latch member 35 is moved to the left by the biasing force of the spring 37 to be returned to the position shown in FIG. 5 while rotating in the clockwise direction due to engagement between the engagement portion 35*c* and the protruded portions 34*b*, 34*c* of the actuator 34.

If the arrangement using the latch member 35 is not utilized, and when the carriage 9*a* is escaped from the recovery and cap position 13*c* toward that side of the apparatus, the actuator 34 must push the slide member 32 downwardly only the force of the biasing means to get over the slide member 32. However, in the arrangement according to the illustrated embodiment, the slide member 32 and the clutch member are not operated while the actuator 34 is being returned. Accordingly, regardless of the stroke absorbing spring 33 and the clutch separating spring 25 (internal springs), the biasing means for the actuator 34 may merely have a biasing force sufficient to overcome the biasing force of the weaker spring 37 for the latch member 35. Incidentally, the spring 37 for the latch member 35 merely serves to return the latch member 35, on which any load acts, to the waiting position after the latch member 35 has gotten over the slide member 32, and, thus, the biasing force thereof may be very small. Accordingly, the driving force required for the carriage 9*a* can be minimized.

(Sheet Feeding Operation)

Next, the sheet feeding operation will be explained.

When image recording information is sent to the image forming apparatus from an external information equipment such as a computer or a word processor, the control means moves the carriage 9*a* from the preliminary dispensing position 13*a* to the feeding trigger position 13*b*. Meanwhile, the abutment portion 9*d* of the carriage 9*a* abuts against the abutment portion 34*a* of the actuator 34, thereby moving the actuator 34 in a direction indicated by the arrow D1 (FIG. 6).

The cam surface 35*e* of the abutment portion 35*a* of the latch member 35 moved in the direction indicated by the arrow D1 together with the actuator 34 urges the cam 32*b* of the slide member 32, thereby moving the slide member 32 in the direction indicated by the arrow C1.

The slide member 32 rotates the link member 31 in the clockwise direction as shown in FIG. 6, thereby moving the clutch trigger gear 24 against the biasing force of the spring 25.

Further, when the carriage 9*a* reaches the feeding trigger position 13*b*, a state shown in FIG. 7 is reached, where the clutch trigger gear 24 abuts against and engages with the clutch gear 26 completely.

Then, the control means rotate the drive motor 14 reversely to rotate the conveying roller shaft 6*b* and the conveying roller 6 in the clockwise direction in FIG. 1 (reverse feeding direction) via the gear 6*a*.

As explained in connection with FIG. 4, the reverse rotation of the conveying roller shaft 6*b* is transmitted to the clutch trigger gear 24 as rotation in the direction indicated by the arrow d through the input gear 18, the speed reduction sun gear 20, the planetary gear 29 and the spring clutch output gear 22. Since the clutch trigger gear 24 is meshed with the clutch gear 26, the driving force is transmitted from the clutch trigger gear 24 to the clutch gear 26 and is further transmitted to the output gear 27, thereby rotating the feeding roller 2 in the clockwise direction (FIG. 1).

Consequently, the cam attached coaxially with the feeding roller 2 is also rotated, with the result that the large diameter portion of the cam lowering the sheet resting table 1 is retracted, thereby lifting the sheet resting table 1 by the spring (not shown). The feeding roller 2 starts to be rotated from the waiting state (FIG. 1) in that the small diameter portion 2*c* which does not contact with the sheet is opposed to the sheet resting table 1. The sheet P rested on the lifted sheet resting table 1 abuts against a start point 2*b* of the large diameter portion 2*a* of the feeding roller 2, thereby starting the conveyance of the sheet P.

In the waiting state, since the toothless portion 27*b* of the output gear 27 is opposed to the clutch trigger gear 24, these gears are not engaged with each other. However, when the output gear 27 is rotated, the toothless portion 27*b* is moved to engage the output gear 27 with the clutch trigger gear 24.

In a state that the sheet resting table 1 is lowered by the rotating cam, the print-motor M1 is driven at a predetermined timing before the sheet is contacted with the feeding roller 2, thereby escaping the carriage 9*a* in a direction indicated by the arrow D2. This timing is determined by measuring a time or counting a number of steps of the drive motor 14 on the basis of a receiving time for the detection signal from the waiting position detecting sensor S for the feeding roller 2.

When the carriage 9*a* is escaped, the actuator 34 is moved in the direction indicated by the arrow D2 by the biasing force of the spring 80, the slide member 32 is moved in a direction indicated by the arrow C2 and the link member 31 is rotated in the anti-clockwise direction. Since the cam and a portion of the sheet resting table 1 contacting with the cam are molded from resin, a friction force therebetween is small, and, thus, the load acting on the output gear 27 is also small. Accordingly, in this case, since the friction force which the clutch trigger gear 24 receives from the output gear 27 is small, the clutch trigger gear 24 is separated from the clutch gear 26 by the biasing force of the spring 25.

Further, the feeding roller 2 may be designed so that the small diameter portion 2*c* thereof not contacting with the sheet is opposed to the sheet resting table 1 when the cam lowering the sheet resting table 1 to the waiting position is separated from the sheet resting table 1. With this arrangement, smallest load acts on the output gear 27 from a time when the cam is separated from the sheet resting table 1 to a time when the sheet P is contacted with the feeding roller 2.

When the clutch trigger gear 24 is separated from the clutch gear 26, the driving force is not transmitted to the clutch gear 26. However, since the clutch trigger gear 24 is engaged with the output gear 27, the driving force is directly transmitted from the clutch trigger gear 24 to the output gear 27, with the result that the feeding roller 2 continues to rotate.

The leading end of the sheet fed by the feeding roller 2 abuts against the nip between the conveying roller 6 and the conveying runner 7 which are reversely rotated. Thereafter, the drive motor 14 is stopped after the sheet is conveyed by a predetermined amount (for example, 3 mm). Although the sheet is flexed between the feeding roller 2 and the nip, the leading end of the sheet is urged against the nip by rigidity of the sheet so that a skew-feed of the sheet is corrected.

Then, when the drive motor 14 is driven in the forward direction, the conveying roller 6 is rotated in the anti-clockwise direction to feed the sheet between the recording head 9*b* and the platen 8, thereby feeding a leading end of the sheet to an initial position.

When the drive motor 14 is rotated forwardly, as explained in connection with FIG. 3, the speed reduction sun gear 20 rotated in the direction indicated by the arrow b by the driving force from the input gear 18 rotates the pendulum arm 28, thereby separating the planetary gear 29 from the spring clutch output gear 22.

The driving force of the speed reduction sun gear 20 is transmitted from the spring clutch input gear 21 to the spring clutch output gear 22 through the spring clutch 23 and is transmitted to the clutch trigger gear 24 as rotation in the direction indicated by the arrow d. Accordingly, the feeding roller 2 is rotated in the clockwise direction until the toothless portion 27*b* of the output gear 27 is opposed to the clutch trigger gear 24, and then is stopped. In this case, the feeding roller 2 is in the waiting state that the small diameter portion 2*c* thereof not contacting with the sheet is opposed to the sheet resting table 1.

As mentioned above, in the image forming apparatus according to the present invention, since the drive transmission is effected by utilizing the spring clutch or the one-way clutch of needle type having a quick switching ability when the drive motor is rotated in the forward direction and by utilizing an inexpensive one-way clutch of pendulum type when the drive motor is rotated in the reverse direction, nevertheless the inexpensive and simple arrangement in which the number of gears for the drive transmission is differentiated between the forward rotation and the reverse rotation by one or odd number is used, the positive entering of the sheet into the nip of the conveying roller after the correction of the skew-feed can be ensured.

Further, since the engagement means are provided with the urging member adapted to urge the moving means when the engagement means are moved in association with the movement of the image forming portion and to be urged and retracted by the moving means when the engagement means are moved in the direction opposite to the engaging direction by the biasing force of the biasing means, biasing means having a small biasing force can be used. As a result, the movement of the engagement means can be facilitated, and the separation of the clutch member can be facilitated accordingly, thereby providing drive transmitting means in which the separation of the clutch member is facilitated.

Further, by setting the push-in stroke of the clutch means to a value greater than the required moving amount and by providing the elastic deformable portion in the transmission path, an inexpensive apparatus which does not rely upon the accuracy of parts can be provided.

Further, by inclining the surfaces of the clutch teeth of the clutch means and the gear portion associating with the drive transmission at a predetermined angle with respect to the engaging/disengaging direction of the clutch member, the separation of the clutch member can be facilitated.

In addition, by designing so that the slight gap is created between the clutch teeth when the phases of the gears on the outer peripheries of the clutch member and the gear portion are aligned with each other, the separation of the clutch member can be facilitated.

What is claimed is:

1. A sheet feeding apparatus comprising:

a feeding roller for separating and feeding a sheet;

a conveying roller for conveying the sheet;

a drive motor directly connected to said conveying roller and for rotating forwardly and reversely;

drive intermittent means for selectively transmitting a driving force from said drive motor to said feeding roller; and drive switching means for rotating said feeding roller in a conveying direction regardless of a rotational direction of said drive motor, wherein said drive switching means uses a spring clutch as a one-way clutch for effecting a drive transmission when said drive motor rotates said conveying roller in the conveying direction as a forward rotation and uses a clutch of pendulum type as a one-way clutch for effecting the drive transmission when said drive motor rotates said conveying roller in a direction opposite to the conveying direction as a reverse rotation, and a number of gears used for the forward rotation is different from a number of gears used for the reverse rotation by one gear or an odd number of gears.

2. A sheet feeding apparatus according to claim 1, wherein a one-way clutch of needle type is used in place of said spring clutch.

3. A sheet feeding apparatus according to claim 1, wherein said clutch of pendulum type is designed so that two gears to which the driving force is to be transmitted are spaced apart from each other and one of said two gears is a sun gear, and a planetary gear meshed with said sun gear is supported by an arm for rotational movement around said sun gear, wherein said planetary gear is rotated depending on a rotational direction of said sun gear by applying a load between said sun gear and said arm thereby to engage said planetary gear with the other of said two gears to which the driving force is to be transmitted.

4. An image forming apparatus comprising:

a feeding roller for feeding out a sheet;

sheet stacking means for stacking sheets thereon and movable toward said feeding roller in association with rotation of said feeding roller to about the sheets against said feeding roller;

a conveying roller for conveying the sheet fed by said feeding roller;

an image forming portion for forming an image on the sheet conveyed by said conveying roller while moving in a direction perpendicular to a sheet conveying direction;

a motor for driving said conveying roller directly; and drive transmitting means including a gear portion directly connected to said feeding roller, clutch means for selectively engaging with and disengaging from said gear portion thereby to transmit a driving force of said motor to said gear portion, and engagement means for engaging said clutch means with said gear portion in association with the movement of said image forming portion, wherein once said clutch means is engaged with said gear portion, said feeding roller is rotated through a predetermined number of revolutions even after an engagement between said gear portion and said clutch means is released, wherein after said clutch means is engaged with said gear portion of said feeding roller by said engagement means, the engagement is released before the sheet abuts against said feeding roller.

5. An image forming apparatus according to claim 4, further comprising a position sensor for detecting a position of said feeding roller or a position of said sheet stacking means movable toward said feeding roller in association with the rotation of said feeding roller, and control means for controlling a movement of said image forming portion so as to release said engagement before the sheet abuts against said feeding roller, based on a detection signal from said position sensor.

6. An image forming apparatus comprising:

a feeding roller for feeding out a sheet stacked on sheet stacking means;

a conveying roller for conveying the sheet fed by said feeding roller;

an image forming portion for forming an image on the sheet conveyed by said conveying roller while moving in a direction perpendicular to a sheet conveying direction;

a motor for driving said conveying roller directly;

a moving motor for moving said image forming portion;

drive transmitting means including a gear portion directly connected to said feeding roller, clutch means for selectively engaging with and disengaging from said gear portion to transmit a driving force of said motor to said gear portion, and moving means for moving said clutch means to engage said clutch means with said gear portion, wherein once said clutch means is engaged with said gear portion, said feeding roller is rotated through a predetermined number of revolutions even after an engagement between said gear portion and said clutch means is released;

engagement means for engaging said clutch means with said gear portion through said moving means in association with a movement of said image forming portion;

biasing means for biasing said engagement means in a direction against a movement in an engagement direction of said engagement means; and an urging member provided on said engagement means and for urging said moving means when said engagement means is moved in association with the movement of said image forming portion while being retracted by urged by said moving means on coming into contact with said moving means when said engagement means is moved by a biasing force of said biasing means.

7. An image forming apparatus according to claim 6, wherein said moving means is provided with a cam portion for engaging with said urging member moving together with said engagement means in association with the movement of said image forming portion to move said moving means to engage said clutch means with said gear portion while engaging with said urging member moving together with said engagement means by the biasing force of said biasing means to move said urging member in a retracting direction.

8. An image forming apparatus according to claim 7, wherein when said engagement means is moved in association with the movement of said image forming portion, said urging member is engaged with an engaging portion formed on said engagement means so that said urging member cannot be retracted, and when said engagement means is moved by the biasing force of said biasing means, said urging member is moved to be disengaged from said engaging while abutting against said cam portion and thereafter said urging member is moved in the retracting direction.

9. An image forming apparatus according to claim 7, wherein said moving means includes a moving member having said cam portion and being moved by urged by said engagement means, a rotary member for urging said clutch means toward said gear portion, and an elastic deformable portion disposed between said moving member and said rotary member, wherein said moving means moves said clutch means by an amount greater than a moving amount required for engaging said clutch means with said gear portion and an over-stroke of said moving means is absorbed by said elastic deformable portion.

10. An image forming apparatus according to claim 6, wherein said clutch means and said gear portion respectively have sawtooth clutch teeth which are engaged with each other when said clutch means are engaged with said gear portion, and surfaces of said clutch teeth for transmitting the driving force are inclined at a predetermined angle with respect to engaging and disengaging directions of said clutch means.

11. An image forming apparatus according to claim 10, wherein said clutch teeth are inclined at about five degrees.

12. An image forming apparatus according to claim 10 or 11, wherein surfaces of said clutch teeth opposed to said surfaces for transmitting the driving force are inclined to reduce tip end faces of said clutch teeth.

13. An image forming apparatus according to claim 6, 10 or 11, wherein said clutch means and said gear portion are provided at their outer peripheries with gears for rotating said feeding roller through the predetermined number of revolutions even after an engagement between said gear portion and said clutch means is released once said clutch means is engaged with said gear portion, and when said gears formed on the outer peripheries of said clutch means and said gear portion are aligned with each other in phase, gaps between said surfaces for transmitting the driving force of said clutch teeth are created.

14. A sheet feeding apparatus comprising:

a feeding roller for feeding a sheet;

a conveying roller from conveying the sheet fed by said feeding roller in a predetermined conveying direction;

a pinch roller cooperating with said conveying roller to pinch the sheet therebetween;

a drive source for driving said conveying roller to convey the sheet in the predetermined conveying direction by rotation of said drive source in a first direction and for driving said conveying roller to convey the sheet in a direction opposite to the predetermined conveying direction by rotation of said drive source in a second direction opposite to the first direction;

first drive transmitting means having a one-way clutch and for rotating said feeding roller in a feeding direction by transmitting the rotation in the first direction of said drive source via said one-way clutch and not to transmit the rotation in the second direction; and second drive transmitting means having first and second gears which are engaged with each other to transmit the driving force when said drive source is rotated in the second direction and are disengaged from each other not to transmit the driving force when said drive source is rotated in the first direction and for transmitting the rotation of said drive source in the second direction to rotate said feeding roller in the feeding direction and not to transmit the rotation of said drive source in the first direction.

15. A sheet feeding apparatus according to claim 14, wherein said one-way clutch comprises a first rotary member rotated by said drive source and a second rotary member rotatable about a rotary axis common to said first rotary member, and further comprising a drive transmitting member designed to receive a driving force from said first rotary member via friction to transmit the driving force to said second rotary member via friction when said drive source is rotated in the first direction.

16. A sheet feeding apparatus according to claim 15, wherein said drive transmitting member includes a coil spring winding round said first and second rotary members to tighten said first and second rotary members when said drive source is rotated in the first direction.

17. A sheet feeding apparatus according to claim 15, wherein said drive transmitting member includes a runner or a ball disposed between said first and second rotary members to be brought into pressure-contact with said first and second rotary members when said drive source is rotated in the first direction.

18. A sheet feeding apparatus according to claim 15, wherein said first gear is a planetary gear meshed with a sun gear rotated by said drive source and said second gear is integrally provided with said second rotary member so that said first and second gears are engaged with each other when said drive source is rotated in the second direction, and said first gear is revolved around said sun gear to be disengaged from said second gear when said drive source is rotated in the first direction; and said sun gear is meshed with a gear integrally provided with said first rotary member to transmit the driving force to said first rotary member.

19. A sheet feeding apparatus according to claim 14, wherein said first gear is a planetary gear meshed with a sun gear rotated by said drive source, which planetary gear is engaged with said second gear when said drive source is rotated in the second direction and is revolved around said sun gear to be disengaged from said second gear when said drive source is rotated in the first direction.

20. A sheet feeding apparatus according to claim 14, further comprising control means for controlling said drive source in such a manner as to cause said feeding roller to fed out the sheet by rotating said drive source in the second direction and to abut a leading end of the sheet against a nip between said conveying roller rotating in an opposite direction and said pinch roller to flex the sheet and then to cause said conveying roller to convey the sheet in the predetermined conveying direction by rotating said drive source in the first direction.

21. A sheet feeding apparatus according to claim 14, further comprising recording means for forming an image on the sheet conveyed by said conveying roller.

22. A sheet feeding apparatus comprising:

a feeding roller for feeding out a sheet from a sheet stack;

a first gear for transmitting a driving force to said feeding roller and having an entire peripheral gear portion including teeth along an entire circumferential direction thereof and a partially toothless gear portion including a toothless portion having no teeth in a predetermined area along the circumferential direction;

a second gear rotated by a driving force from a drive source and for transmitting the driving force when engaged with said partially toothless gear portion of said first gear and not to transmit the driving force when opposed to said toothless portion;

a third gear meshed with said first gear through said entire peripheral gear portion; and a clutch for selectively transmitting rotation of said second gear to said third gear, wherein in a state that said second gear is opposed to said toothless portion, the rotation of said second gear is transmitted to said third gear via said clutch, said first gear is rotated by said third gear which is rotating so that an engagement between said partially toothless gear portion and said second gear is started and transmission of rotation effected by said clutch is released after the engagement between said partially toothless gear portion and said second gear is started, thereby rotating said feeding roller until said toothless portion is opposed to said second gear.

23. A sheet feeding apparatus according to claim 22, wherein said clutch transmits the rotation by engaging said second gear with said third gear by engagement portions provided on said second and third gears, respectively.

24. A sheet feeding apparatus according to claim 23, further comprising engagement means for positioning said second gear in a position where said second gear is engaged with said third gear, and a clutch separation spring for disengaging said second gear from said third gear by a biasing force when an action of said engagement means on said second gear is released.

25. A sheet feeding apparatus according to claim 24, further comprising support means for supporting the sheet stack, biasing means for biasing said support means to said feeding roller, and a cam for separating said support means from said feeding roller against a biasing force of said biasing means and rotated by the driving force of said first gear to permit said biasing means to abut the sheet stack supported by said support means against said feeding roller.

26. A sheet feeding apparatus according to claim 25, wherein the action of said engagement means is released before the sheet stack abuts against said feeding roller.

27. A sheet feeding apparatus according to claim 22, further comprising recording means for recording an image on the sheet fed by said feeding roller.

28. A sheet feeding apparatus comprising:

a feeding roller for feeding out a sheet from a sheet stack;

a first gear for transmitting a driven force to said feeding roller and having a toothless portion in a predetermined area along a circumferential direction thereof;

a second gear rotated by a driving force from a drive source and for transmitting the driving force when engaged by said first gear and not to transmit the driving force when opposed to said toothless portion;

trigger means for starting an engagement between said first and second gears by rotating said first gear in a state that said second gear is opposed to said toothless portion;

a cam for acting on a follower portion provided on said trigger means to operate said trigger means;

support means for supporting said cam and for causing said cam to act on said follower portion when said support means are moved in a predetermined direction; and biasing means for biasing said support means in a direction opposite to the predetermined direction, wherein when said support means are moved by said biasing means in the direction opposite to the predetermined direction and when said cam abuts against said follower portion, said cam is retracted by said follower portion.

29. A sheet feeding apparatus according to claim 28, wherein said first gear includes a partially toothless gear portion having said toothless portion, and an entire peripheral gear portion including teeth along an entire circumferential direction thereof;

said trigger means includes a third gear meshed with said first gear through said entire peripheral gear portion, and a clutch for selectively transmitting rotation of said second gear to said third gear; and in a state that said second gear is opposed to said toothless portion, the rotation of said second gear is transmitted to said third gear via said clutch, and an engagement between said partially toothless gear portion and said second gear is started by rotating said first gear by said third gear which is rotating, and a transmission of rotation effected by said clutch is released after the engagement between said partially toothless gear portion and said second gear is started, thereby rotating said feeding roller until said toothless portion is opposed to said second gear.

30. A sheet feeding apparatus according to claim 29, wherein said clutch transmits the rotation by engaging said second gear with said third gear by engagement portions provided on said second and third gears, respectively; and said trigger means includes engagement means for being pushed by said cam to position said second gear in a position where said second gear is engaged with said third gear, and a clutch separation spring for disengaging said second gear from said third gear by a biasing force when an action of said engagement means on said second gear is released.

31. A sheet feeding apparatus according to claim 28, further comprising recording means for forming an image on the sheet fed by said feeding roller while moving in a width-wise direction of the sheet, and wherein said support means are moved in the predetermined direction while being pushed by said recording means which is moving.

32. A sheet feeding apparatus according to claim 31, wherein said recording means effects recording by discharging ink.

* * * * *

UNITED STATES PATENT AND TRADEMARK OFFICE

CERTIFICATE OF CORRECTION

PATENT NO. : 6,336,759 B1
DATED : January 8, 2002
INVENTOR(S) : Yuji Nakano

It is certified that error appears in the above-identified patent and that said Letters Patent is hereby corrected as shown below:

Title page,
Item [56], Reference Cited, U.S. PATENT DOCUMENTS,
"Matasuhisa" should read -- Matsuhisa --.

Item [57], ABSTRACT,
Line 12, "forwardly" should read -- forward --.

Column 1,
Line 10, "been" should read -- be --.

Column 2,
Line 24, "type" should read -- type, both of --.

Column 4,
Line 57, "out" should read -- off --.

Column 5,
Line 49, "th e" should read -- the --.
Line 53, "arrangement" should read -- arrangements --.

Column 6,
Line 24, "arm 20" should read -- arm 28 --.
Line 40, "in actual," should read -- actually, --.

Column 8,
Line 15, "becomes" should read -- becomes in --.

Column 9,
Line 12, "rotatingly" should read -- rotatively --.

Column 12,
Line 38, "since" should be deleted.

Column 15,
Line 7, "that" should read -- so that --.

Column 16,
Line 32, "about" should read -- abut --.

UNITED STATES PATENT AND TRADEMARK OFFICE

CERTIFICATE OF CORRECTION

PATENT NO. : 6,336,759 B1
DATED : January 8, 2002
INVENTOR(S) : Yuji Nakano

It is certified that error appears in the above-identified patent and that said Letters Patent is hereby corrected as shown below:

Column 17,
Line 35, "urged by" should be deleted.
Line 56, "ing" should read -- ing portion --.
Line 61, "moved by" should be deleted.

Column 18,
Line 7, "are" should read -- is --.
Line 33, "from" should read -- for --.
Line 48, "to" should be deleted.
Line 49, "transmit" should read -- transmitting --.
Line 54, "not to" should read -- to not --.

Column 19,
Line 36, "fed" should read -- feed --.
Line 59, "not to transmit" should read -- not transmitting --.

Column 20,
Line 41, "driven" should read -- driving --.
Line 47, "not to transmit" should read -- not transmitting --.

Signed and Sealed this

Thirtieth Day of April, 2002

*Attest:*

*Attesting Officer*

JAMES E. ROGAN
*Director of the United States Patent and Trademark Office*